US009997144B2

(12) United States Patent
Kipness

(10) Patent No.: US 9,997,144 B2
(45) Date of Patent: Jun. 12, 2018

(54) ATTACHMENT DEVICE FOR STRINGED INSTRUMENT AND COUPLING SYSTEM FOR USE WITH THE SAME

(71) Applicant: Aaron H Kipness, Boonton, NJ (US)

(72) Inventor: Aaron H Kipness, Boonton, NJ (US)

( * ) Notice: Subject to any disclaimer, the term of this patent is extended or adjusted under 35 U.S.C. 154(b) by 0 days. days.

(21) Appl. No.: 14/795,904

(22) Filed: Jul. 10, 2015

(65) Prior Publication Data

US 2017/0323623 A1 Nov. 9, 2017

(51) Int. Cl.
*G10D 3/08* (2006.01)
*G10D 3/16* (2006.01)

(52) U.S. Cl.
CPC ..... *G10D 3/16* (2013.01)

(58) Field of Classification Search
CPC ..... G10D 3/08; G10D 3/163
See application file for complete search history.

(56) References Cited

U.S. PATENT DOCUMENTS 3,882,754 A * 5/1975 Godley ..... G10D 3/163 84/320
4,037,503 A 7/1977 Jacobson et al.

OTHER PUBLICATIONS

Dregni, Michael: "The Gizmotron: Most Bizarre Guitar Effect of All Time?", Vintage Guitar Magazine, Mar. 2014, pp. 44-47, Mar. 2014.

* cited by examiner

*Primary Examiner* — Kimberly Lockett
(74) *Attorney, Agent, or Firm* — Brian K Dinicola

(57) ABSTRACT

An attachment for use with a stringed musical instrument comprises a rotatable shaft and groups of one or more string engaging elements coupled to the rotatable shaft. Each string engaging element of a group is positionable in a first orientation for driven rotary engagement with a corresponding string of the musical instrument. Each string engagement element is further positionable in a second orientation. The attachment further includes key actuators operatively associated with the string engaging elements, and each key actuator is manipulable so as to urge each string engaging element of a group into at least one of the first orientation or the second orientation. In an embodiment, the string engaging element(s) operated by each key actuator are rotatable wheels that rotate at a slower rate or a faster rate, depending on whether or not corresponding strings is/are bent toward the corresponding wheel(s).

19 Claims, 7 Drawing Sheets

FIG 4
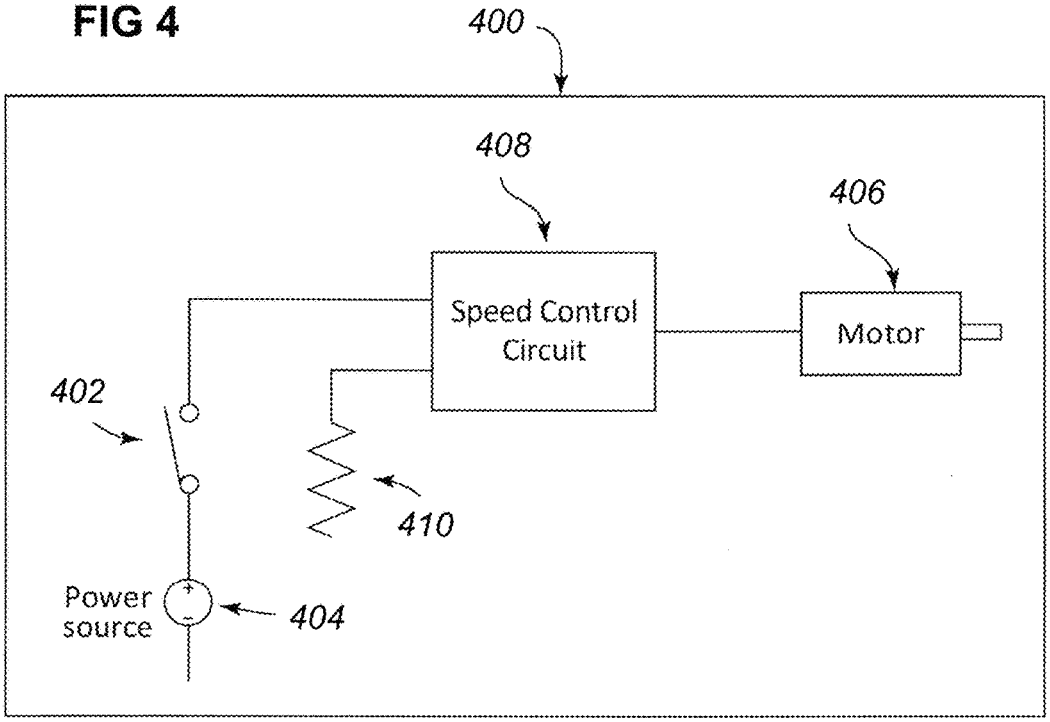
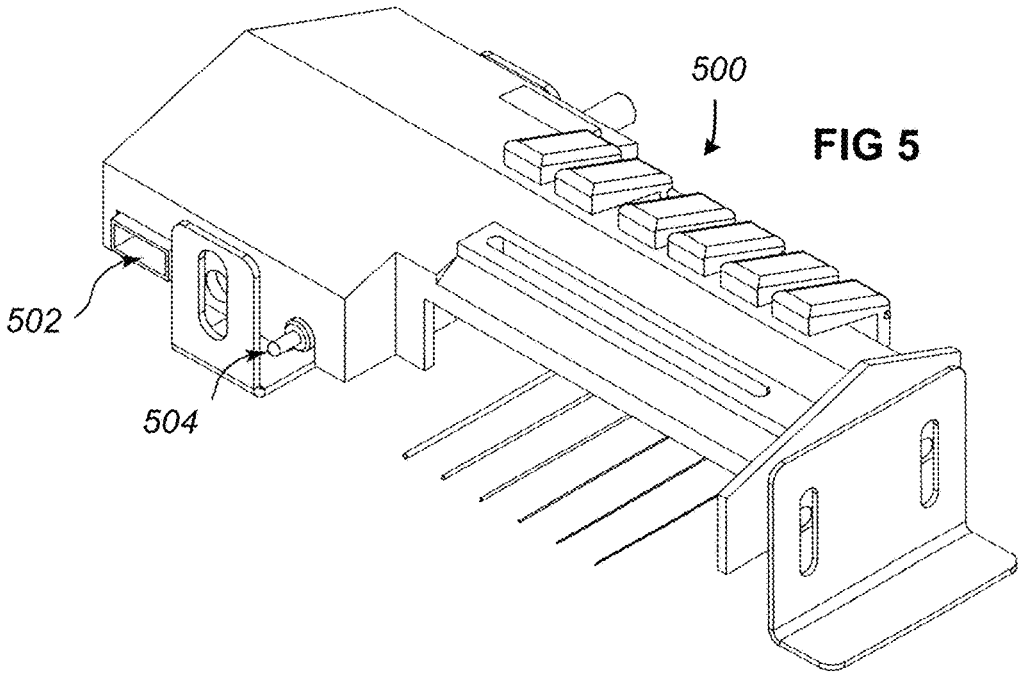
FIG 5

ATTACHMENT DEVICE FOR STRINGED INSTRUMENT AND COUPLING SYSTEM FOR USE WITH THE SAME

BACKGROUND OF THE INVENTION

Field of the Invention

Embodiments generally relate to musical instruments and, more particularly, to systems and methods for modifying and/or operating stringed musical instruments such, for example, as guitars.

Description of the Related Art

Stringed musical instruments such as electrical guitars and basses, are capable of producing a wide range of tones—through such motions of the operations of a player's fingers as plucking, strumming, and hammering. To extend the capabilities of stringed instrument beyond these basic operations, a variety of attachment devices have been proposed. One such device, for example, incorporates mechanical means for "bowing" one or more of the strings as it is being played.

The inventor herein has observed that mechanical attachments of the aforementioned type do not provide the player of a stringed instrument with precise control over the timbre and tonal quality of the sounds produced.

SUMMARY OF THE INVENTION

The Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to one or more embodiments, an attachment for use with a stringed musical instrument comprises a rotatable shaft and groups of one or more string engaging elements coupled to the rotatable shaft. Each string engaging element of a group is positionable in a first orientation for driven rotary engagement with a corresponding string of the musical instrument. Each string engagement element is further positionable in a second orientation. In embodiments, positioning of a string engaging element in the second orientation interrupts or prevents contact and/or driven rotary engagement with a corresponding string. The attachment further includes key actuators operatively associated with the string engaging elements. In embodiments, each key actuator is manipulable so as to urge the string engaging element(s) of a group into at least one of the first orientation or the second orientation. In an embodiment, the string engaging element(s) operated by each key actuator are rotatable wheels that rotate at a slower rate or a faster rate, depending on whether or not corresponding strings is/are bent toward the corresponding wheel(s).

In another embodiment, a musical instrument comprises a neck; a body; a plurality of strings coupled to the neck and body so as to permit vibration relative thereto; and an attachment. The attachment comprises a rotatable shaft and respective groups of one or more string engaging elements coupled to the rotatable shaft. Each string engaging element of a group is positionable in a first orientation for driven rotary engagement with a corresponding string of the musical instrument. Each string engagement element is further positionable in a second orientation. The attachment further includes key actuators operatively associated with the string engaging elements, the key actuators being respectively manipulable so as to urge the corresponding string engaging elements of a group into at least one of the first orientation or the second orientation. In an embodiment, the string engaging element(s) operated by each key actuator are rotatable wheels that rotate at a slower rate or a faster rate, depending on whether or not corresponding strings is/are bent toward the corresponding wheel(s).

In another embodiment, a coupling system for securing, to a stringed musical instrument, an attachment that includes a housing defining a plurality of attachment points, a rotatable shaft, groups of one or more string engaging elements, and respective key actuators, comprises a plurality of mounting blocks. Each mounting block defines a planar mounting surface and at least one transverse bore. The coupling system further includes a plurality of pivotable rods each having a proximal portion defining a transverse recess alignable with the at least one transverse bore of a corresponding mounting block and a distal threaded portion dimensioned and arranged for threaded engagement with one of the attachment points. The coupling system further includes a plurality of mounting screws, each insertable through a respective transverse recess into a transverse bore of a corresponding mounting block.

BRIEF DESCRIPTION OF THE DRAWINGS

FIG. 4 a block diagram depicting an exemplary electric circuit for selectively rotating a group of one to n string engaging elements in accordance with embodiments consistent with the present disclosure;

FIG. 5 is a rear perspective view of the embodiment of FIG. 1, depicting the location of a power port and on/off switch in accordance with embodiments consistent with the present disclosure;

Figure 1:
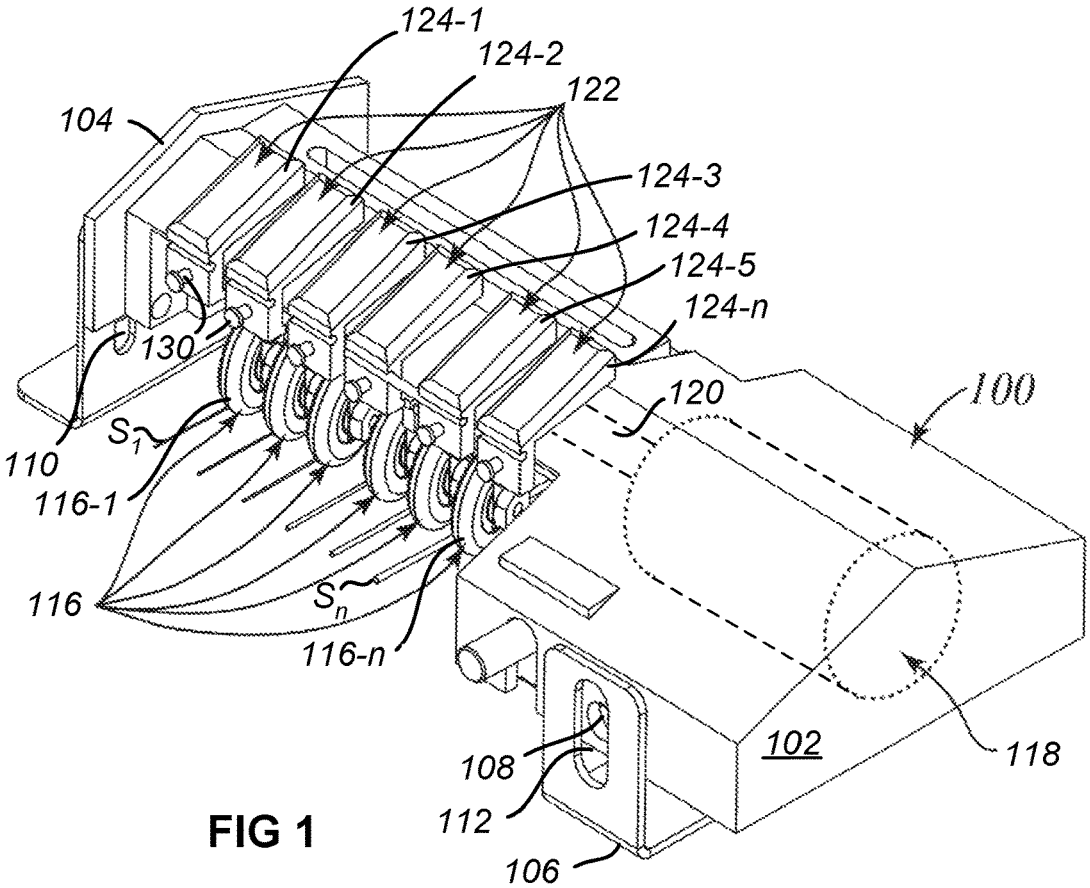
FIG. 1 is a perspective view of an attachment for a stringed instrument according to one or more embodiments consistent with the present disclosure.

While the method and apparatus is described herein by way of example for several embodiments and illustrative drawings, those skilled in the art will recognize that the method and apparatus for modifying and operating a stringed instrument is not limited to the embodiments or drawings described. It should be understood, that the drawings and detailed description thereto are not intended to limit embodiments to the particular form disclosed. Rather, the intention is to cover all modifications, equivalents and alternatives falling within the spirit and scope of the method and apparatus for modifying and operating a stringed instrument. Any headings used herein are for organizational purposes only and are not meant to limit the scope of the description or the claims. As used herein, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

Systems and techniques for modifying and operating a stringed instrument are described. Embodiments of the present disclosure overcome a number of deficiencies which the inventor herein has identified in the prior art. In U.S. Pat. No. 3,882,754 issued to Godley, for example, there is disclosed a surface-mounted device which includes a plurality of rubber wheels. Each of the rubber wheels is respectively attached to a corresponding one of a plurality of keys. When aligned and individually depressed, the rubber wheels rotate against respective strings, producing a bowing effect similar to violin or upright bass. The Godley device operates at a fixed, constant speed of rotation, providing a predictable timbre or tonal effect having a duration determined by the amount of time which the key(s) are depressed.

In contrast with the system disclosed by Godley, systems according to one or more embodiments consistent with the present disclosure provide the user with complete and variable control over the timbre or tonal quality of the sounds being produced by the stringed instrument to which it is coupled. In an embodiment, an attachment for modifying a stringed instrument includes a plurality of groups of one or more key actuated, rotating wheels. The rotation speed of each key-actuated wheel is variable over a range of speeds. The range includes a slower speed of rotation (e.g., from about 2000 to about 2750 rpm). At slower speeds of wheel rotation, the user can operate a stringed instrument to produce mellow tones. The range also includes a higher speed of rotation. At faster speeds of wheel rotation (e.g., from about 2750 to about 4300 rpm), the same stringed instrument can be operated to produce a crisper and louder sound.

In one or more embodiments, a driven shaft extends through a hub defined in each wheel. Upon this shaft, each wheel is free to "float" and/or "cant". In an embodiment, the hub of each wheel is slightly enlarged. When the user presses a key, the inner hub bearing surface of a wheel is brought into contact with an exterior surface portion of the rotating shaft, and each wheel so actuated begins to spin. Until the key is pressed, however, the associated key(s) simply maintain a neutral orientation in which no or only minimal spinning occurs. In one or more embodiments, each key is further configured with an inclined geometry so that as that key is depressed, the corresponding wheel(s) of a group is/are caused to cant or "twist" from the neutral position.

Various embodiments of a method and apparatus for modifying and operating a stringed instrument are described. In the following detailed description, numerous specific details are set forth to provide a thorough understanding of claimed subject matter. However, it will be understood by those skilled in the art that claimed subject matter may be practiced without these specific details. In other instances, methods, apparatuses or systems that would be known by one of ordinary skill have not been described in detail so as not to obscure claimed subject matter.

Reference will now be made in detail to exemplary embodiments of the present invention, examples of which are illustrated in the accompanying drawings. Wherever possible, the same reference numbers will be used throughout the drawings to refer to the same or like parts FIG. 1 is a perspective view of an attachment 100 for a musical instrument (of which only strings $S_1$ to $S_n$ are shown) according to one or more embodiments consistent with the present disclosure. The attachment comprises a frame or housing 102 which, in an exemplary embodiment, is securable to a surface of a stringed musical instrument by slotted mounting brackets 104 and 106 and associated fasteners (not shown). That is, apertures in the housing 102, of which only aperture 108 is shown, are aligned with corresponding slots in brackets 104 and 106, as slots 110 and 112 respectively, so as to permit vertical adjustment of the attachment relative to strings $S_1$ to $S_n$ of the musical instrument.

In one or more embodiments, the attachment 100 further includes a plurality of rotatable string engaging elements 116-1 to 116-n (collectively, 116). By appropriate vertical adjustment of the housing 102, a respective one of the rotatable string engaging elements 116-1 to 116-n is aligned with a corresponding one of the strings $S_1$ to $S_n$. A motor 118 drives a rotating shaft 120 which, in turn, causes rotation of the respective string engaging elements. The speed at which a string engaging element is rotated in contact against a corresponding string has a direct effect on the timbre and tonal quality of the sound produced. In an embodiment, and as will be described in greater detail shortly, the speed at which each individual string engaging element rotates is influenced by both of the speed at which the shaft 120 is rotated by motor 118 and the degree to which a corresponding string is urged into contact with the string engaging element.

In some embodiments, each string engaging element of the plurality of string engaging elements 116 descends from a "neutral" position—in which no or only negligible contact is made between the string engaging element and a corresponding string—into an initial string engaging position at which the string engaging element rotates at a lower speed or at a speed within a lower range of speeds. In an embodiment, a plurality 122 of key actuator assembles 122-1 to 122-n (FIGS. 2 and 3A to 3D), each comprising a corresponding key of a plurality 124 of keys 124-1 to 124-n, is manipulated to move the string engaging elements from their neutral position into the initial string engaging position.

Figure 2:
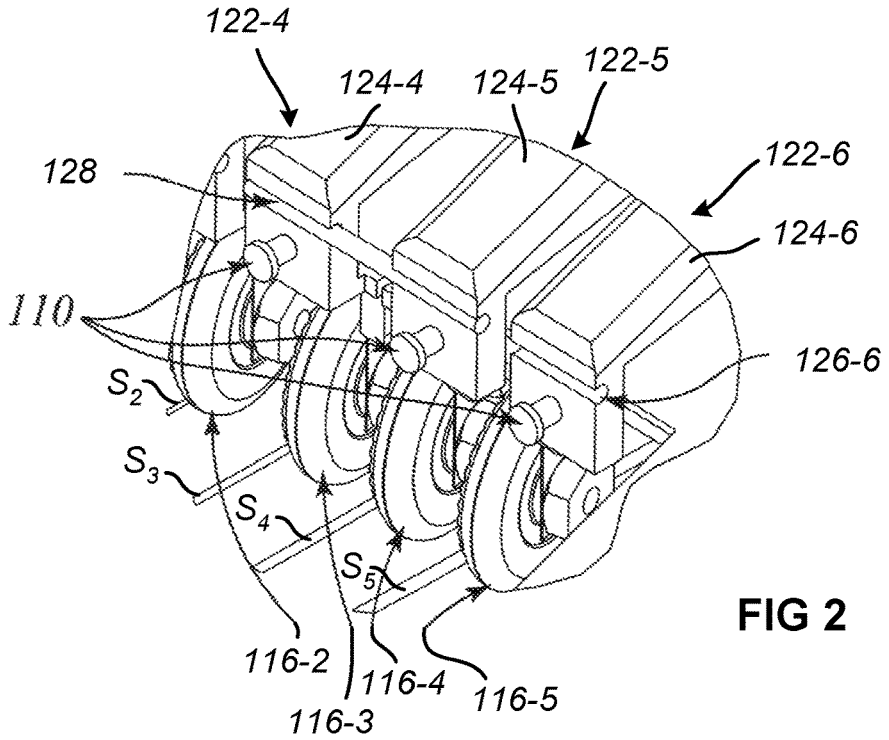
FIG. 2 is a partial perspective view of the embodiment of FIG. 1 depicting, in greater detail, an arrangement of string engaging elements respectively actuated by corresponding keys according to one or more embodiments consistent with the present disclosure.

FIG. 2 is a partial perspective view of the attachment 100 of FIG. 1 depicting, in greater detail, the arrangement of a subset (116-2 to 116-5) of the plurality of string engaging elements 116 relative to strings $S_2$ to $S_5$ and the manner in which the former are arranged so as to be respectively and selectively actuated by a player of a stringed musical instrument according to one or more embodiments consistent with the present disclosure. Each of the key actuator assemblies, as key actuator assemblies 122-4, 122-5 and 122-6 for an instrument having six strings (n=6), comprises a corresponding key as keys 124-4, 124-5 and 124-6. Each key, as key 124-6, defines a gang selector slot, as slot 126-6. Two or more keys can be ganged together by inserting a removable rod 128 into their respective gang selector slots. In the exemplary embodiment of FIGS. 1 and 2, the removable rod 128 is used to gang together keys 124-4 and 124-5, such that depressing either one of those keys results in movement of them both as well as movement of string engaging elements $S_4$ and $S_5$.

With continuing reference to FIGS. 1 and 2, it will be seen that each key actuator assembly further includes a locking pin 130. A player desiring to lock a particular string engaging element into an initial string engaging orientation, or to lock a group of two or more string engaging elements ganged together by a removable rod as rod 128 described above, need only depress a corresponding locking pin 130 to maintain the key(s) and corresponding string engaging element(s) in that orientation. When the locking of a particular key or group of keys is no longer required, the player need only pull out the applicable locking pin(s) 130.

Figure 3A:
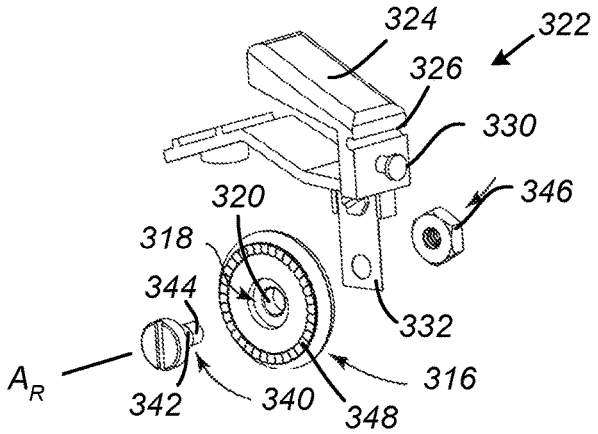
FIG. 3A is an exploded view depicting the elements of a key actuated string engagement assembly according to embodiments consistent with the present disclosure.

FIG. 3A is an exploded view depicting the elements of a key actuated string engagement assembly 322 according to embodiments consistent with the present disclosure. As seen in FIG. 3A, the string engagement assembly comprises a key 324 which defines a gang selector slot 326, locking pin 330, linkage member 332, a string engaging element 316 defining a central bore 318 circumscribed by a bearing surface 320, and a mounting shaft 340 (FIG. 3E) having a smooth proximal portion 342 and a threaded distal portion 344.

Figure 3B:
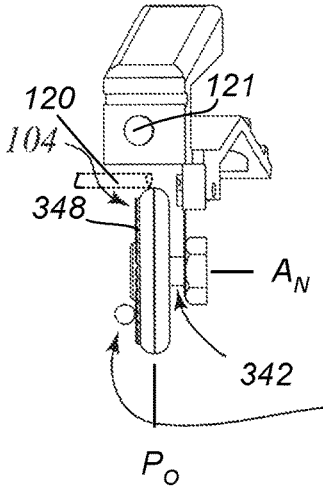
FIG. 3B is a frontal view of a key actuated string engagement assembly according to embodiments consistent with the present disclosure, the assembly of the depicted embodiment including string engaging elements each in the form of a wheel and the wheel depicted being arranged in a "neutral" orientation (i.e., free to twist and/or float, following the movements of an adjacent string, but in a substantially orthogonal orientation relative to the axis of the shaft on which it is rotatably mounted)
Figure 3C:
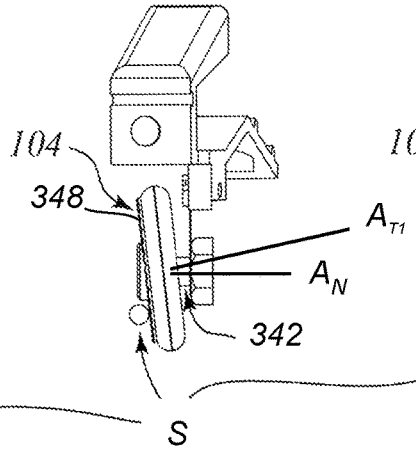
FIG. 3C is a frontal view of a key actuated string engagement assembly according to embodiments consistent with the present disclosure, the string engaging wheel of the depicted embodiment being arranged in a first diverging orientation relative to the neutral position of FIG. 3B.
Figure 3D:
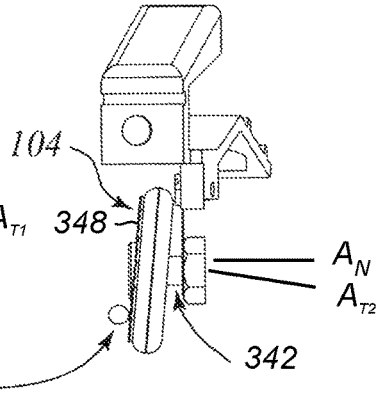
FIG. 3D is a frontal view of a key actuated string engagement assembly according to embodiments consistent with the present disclosure, the string engaging wheel of the depicted embodiment being arranged in a second diverging orientation relative to the neutral position of FIG. 3B.

In embodiments, the diameter of the bore 318 which defines bearing surface 320 is slightly larger than the nominal diameter of smooth proximal portion 342 of shaft 340. As such, the wheel 316 is free to "float" relative to shaft 340 and the nominal axis of rotation defined thereby. When the string engaging wheel 316 is brought into contact with the surface of rotating shaft 120 driven by motor 118 (each, as shown in FIG. 1), the wheel 316 begins to spin. In an embodiment, the keys are slightly angled (e.g., on the order of from about 10 to about 14 degrees), such that when the wheel makes contact with the rotating shaft 120, the rear of the wheel will also twist in the direction of the rotating shaft. This puts only the back of the wheels teeth 348 into contact with the string. This "twist" leads to three distinct orientations or modes These are respectively shown in FIGS. 3B to 3D. As seen in FIGS. 3B to 3D, correspondingly threaded nut 346 receives the threaded distal portion 344 and when nut 346 is tightened appropriately, string engaging element 316 is both retained and free to rotate about an axis passing through the center of bore 320.

FIG. 3B is a frontal view of key actuated string engagement assembly 322 of FIG. 3A according to embodiments consistent with the present disclosure, the assembly of the depicted embodiment including a string engaging element in the form of a wheel and the wheel depicted being arranged in a "neutral" orientation (i.e., free to twist and/or float, following the movements of an adjacent string, but in a substantially orthogonal orientation relative to the axis of the shaft on which it is rotatably mounted).

In the embodiment depicted in FIG. 3B, the string engagement element is bisected by a plane $P_o$ that is orthogonal to the rotation axis $A_N$. FIG. 3C is a frontal view of the key actuated string engagement assembly 322 according to embodiments consistent with the present disclosure, the string engaging wheel of the depicted embodiment being arranged in a first diverging orientation relative to the neutral position of FIG. 3B, while FIG. 3D is a frontal view of a key actuated string engagement assembly according to embodiments consistent with the present disclosure, the string engaging wheel of the depicted embodiment being arranged in a second diverging orientation relative to the neutral position of FIG. 3B. The twisting motion pushes the wheel away from the supporting arm 332 and onto the bearing end of the shaft 340. This keeps the wheel from wobbling. Now, when a string is bent, or pushed into the spinning wheel, it will "untwist" the wheel and force it to ride straighter on the axle. The bearing end of the axle is seated in the face of the wheel so that even when a string is forcing the wheel to twist, there is enough bearing surface still seated in the wheel that the wheel does not wobble. When the wheel is forced into a straighter position against the rotating shaft (FIG. 3B), the wheel speed increases, resulting in greater intensity and volume. This is a much desired effect because the harder one bends the strings, or the more vibrato is demanded by the player, the attachment 100 responds with greater intensity and volume.

Figure 3E:
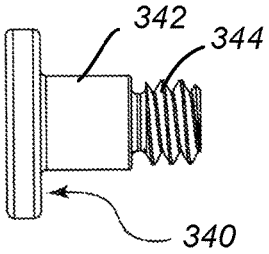
FIG. 3E is an enlarged elevation view of an exemplary fastener forming part of the key actuated string engagement assembly depicted in FIGS. 3A-3D.

FIG. 3E is an enlarged elevation view of an exemplary fastener forming part of the key actuated string engagement assembly depicted in FIGS. 3A-3D.

FIG. 4 a block diagram depicting an exemplary electric circuit for selectively rotating a group of one to n string engaging elements in accordance with embodiments consistent with the present disclosure. The circuit 400 for supplying power for energizing the shaft-rotating motor 406 comprises a conventional speed control circuit 408 which may, for example, comprise a solid state variable speed controller or a simple potentiometer control. A manual on-off switch 402 is included to enable the user to interrupt the flow of current to the speed control circuit 408 and motor 408. In some embodiments, the power source is a battery while in others an A/C power supply or AC/DC power supply is utilized. FIG. 5 is a rear perspective view of the embodiment of FIG. 1, depicting the location of a power port 502 and on/off switch 504 (corresponding, for example, to switch 402 of FIG. 4) in accordance with embodiments consistent with the present disclosure.

Figure 6:
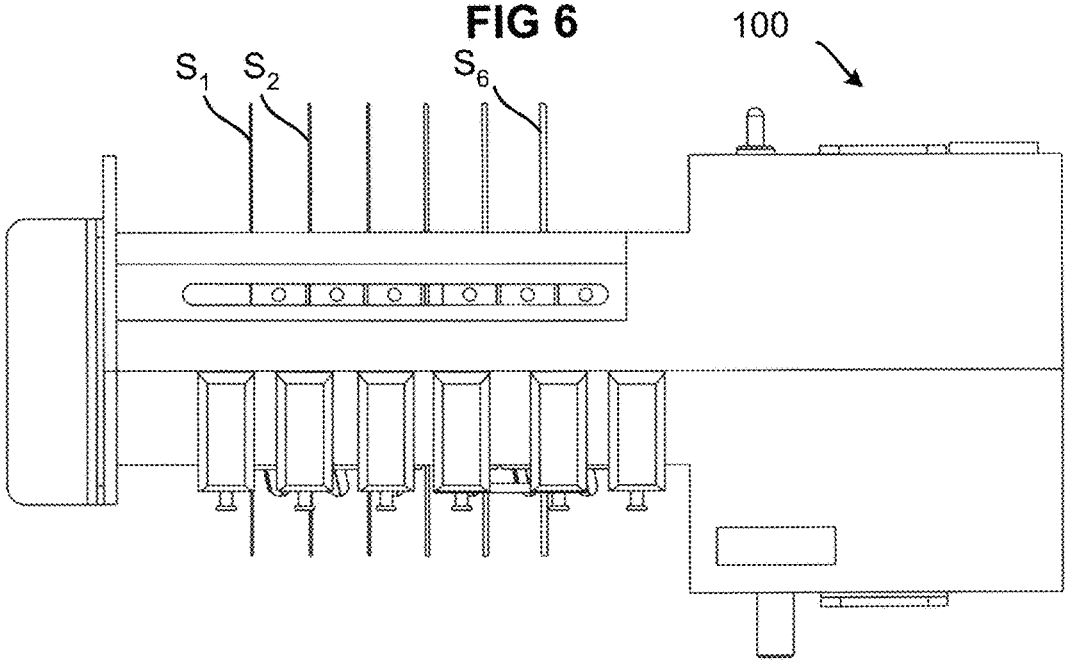
FIG. 6 is a top plan or overhead view showing a positioning of the exemplary attachment depicted in FIG. 1 relative to the strings of a musical instrument consistent with one or more embodiments of the present disclosure.
Figure 7:
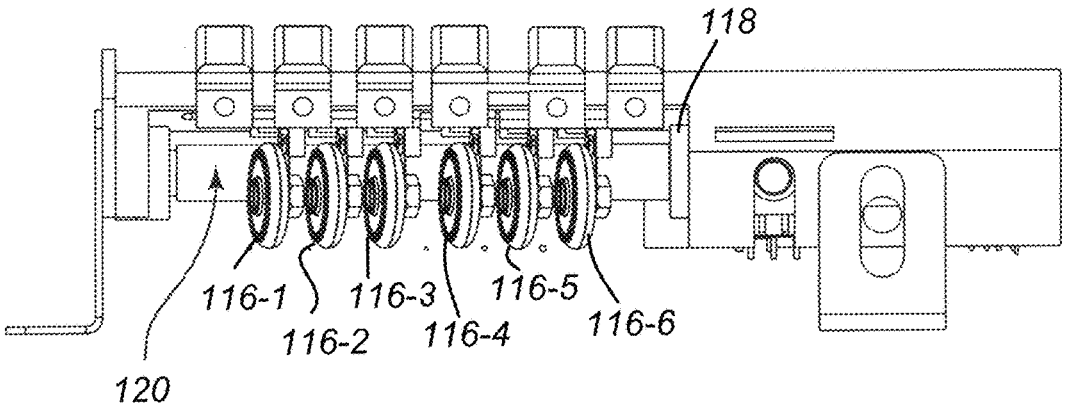
FIG. 7 is a front view of the exemplary attachment device depicted in FIG. 1, showing the placement of a rotatable shaft relative to a group of one or more string engaging elements consistent with one or more embodiments of the present disclosure.

FIG. 6 is a top plan or overhead view showing a positioning of an the exemplary attachment 100 of FIG. 1 relative to the six strings ($S_1$ to $S_6$) of a musical instrument consistent with one or more embodiments of the present disclosure. FIG. 7 is a front view of the exemplary attachment device depicted in FIG. 1, showing the placement of a rotatable shaft relative to a group of one or more string engaging elements consistent with one or more embodiments of the present disclosure.

Figure 8A:
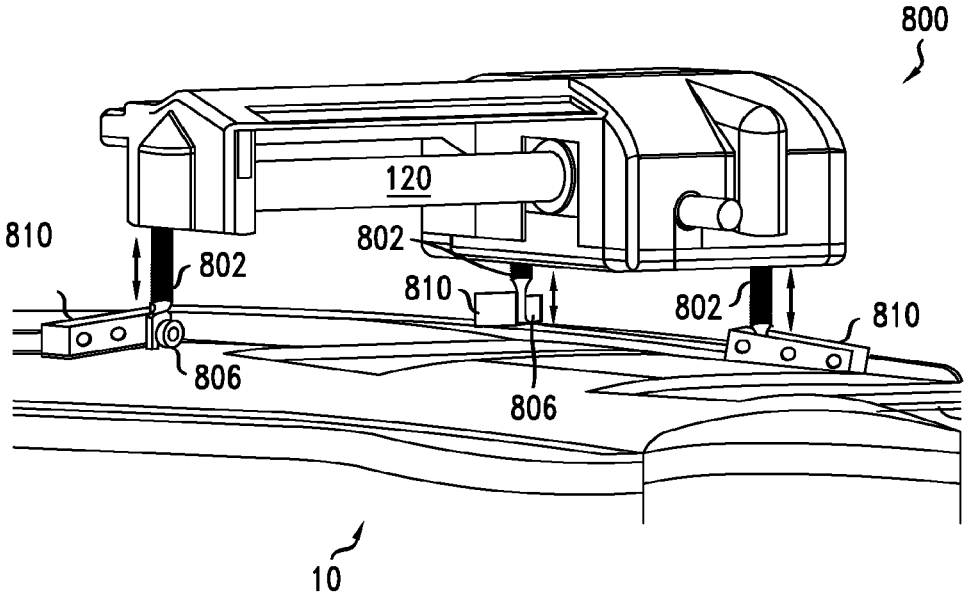
FIG. 8A is a perspective view of an attachment for a stringed instrument constructed according to an alternate embodiment consistent with the present disclosure and utilizing a quick coupling system.

FIG. 8A is a perspective view of an attachment 800 for a stringed instrument constructed according to a modified embodiment consistent with the present disclosure and utilizing a quick coupling system. The coupling system is especially advantageous for use in coupling the housing of attachment structure 800 to an instrument or other structure having non uniform surface features (e.g., surface areas which are non planar or characterized by varying contours). As in the preceding embodiments of FIGS. 1 to 6, the housing of attachment structure 800 defines a plurality of attachment points for securing to a mounting substrate (e.g, the upper surface of a musical instrument), a rotatable shaft, at least one group of one or more string engaging elements, and at least one key actuator coupled to the housing and operatively associated therewith.

Figure 8B:
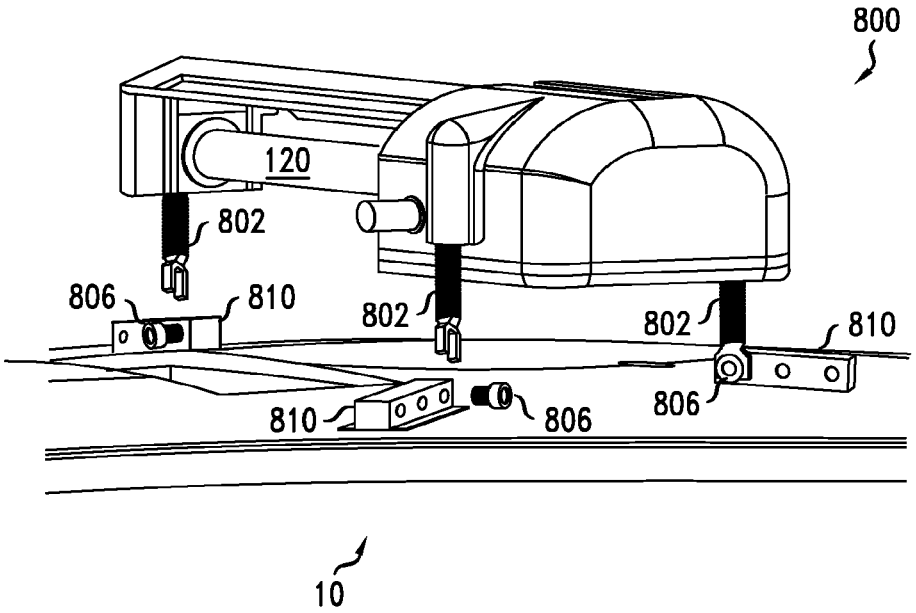
FIG. 8B is another perspective view of the embodiment of an attachment shown in FIG. 8A, illustrating the sequential manner in which a quick coupling system may be used to secure the exemplary attachment to a stringed instrument.
Figure 8C:
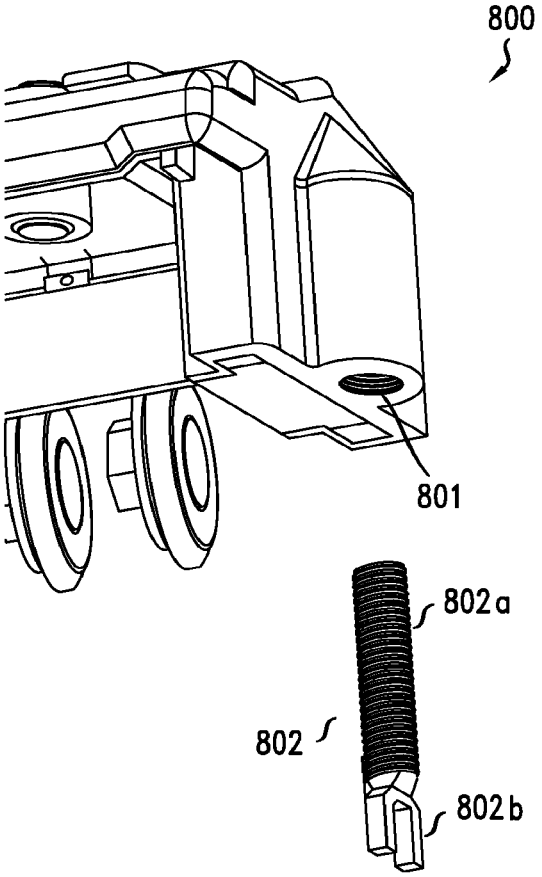
FIG. 8C is a partial exploded view of the embodiment of FIGS. 8A and 8B.
Figure 9A:
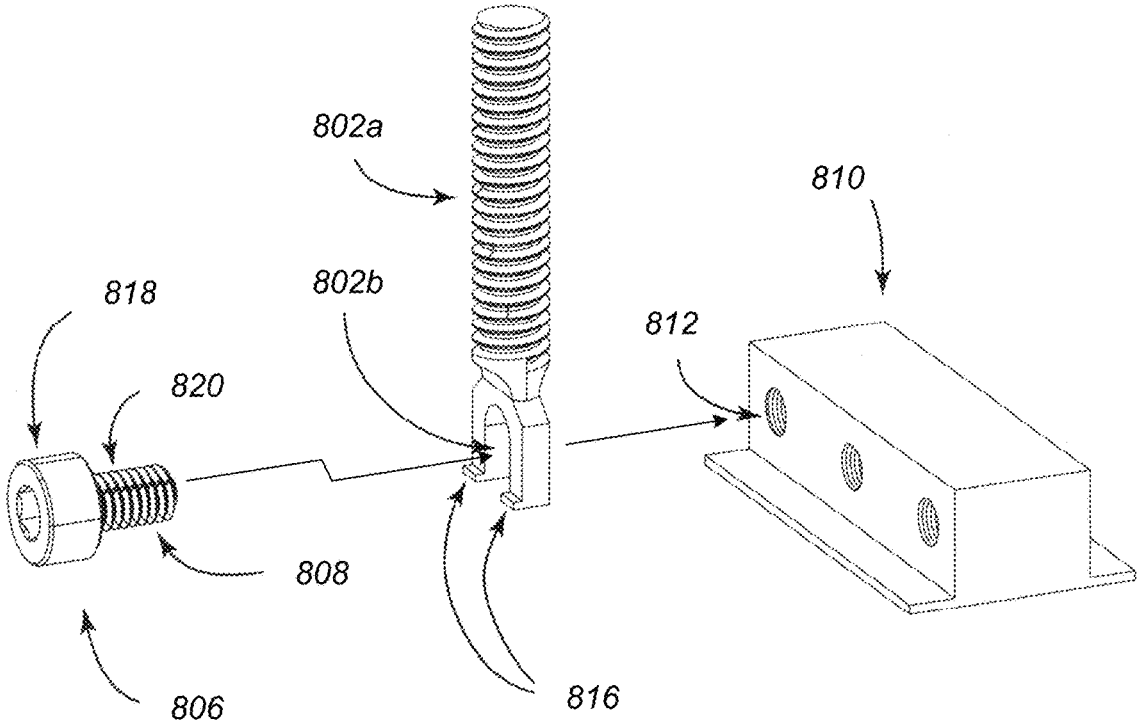
FIG. 9A is an elevation view depicting an assembled coupling module forming part of the quick coupling system depicted in FIGS. 8A-8C.
Figure 9B:
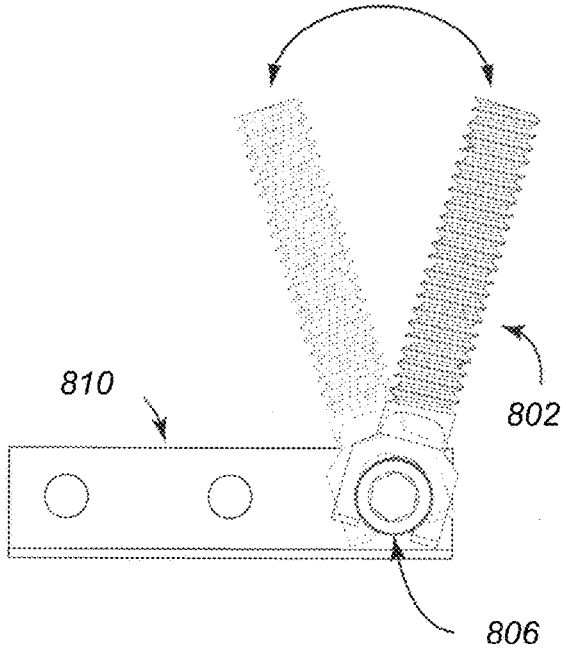
FIG. 9B is an exploded view of the coupling module depicted in FIG. 9A.

As seen in FIGS. 8A-8C, the coupling includes a plurality of mounting blocks 810, each mounting block defining a planar mounting surface and at least one transverse bore 812, and a plurality of pivotable rods 802. As best seen in FIG. 8C, each pivotable rod has a proximal portion 802*b* defining a transverse recess or socket alignable with the at least one transverse bore of a corresponding mounting block and a distal threaded portion 802*a* dimensioned and arranged for threaded engagement with one of the attachment points, as attachment point 801 of the housing of attachment 800. Socket 802*b* accommodates insertion and extraction of a connecting pivot defined by mounting screws 806. FIGS. 9A and 9B illustrate the manner in which mounting screws 806 are respectively insertable through corresponding transverse recesses 802*b* into a transverse bore 812 of each mounting block 810.

The connecting pivot shown as being defined by threaded mounting screws 806 may, of course, be defined by any suitable means of locking connection, that can be secured to a mounting block or pad 810, each of which in this embodiment, contains one or more mating threaded connection(s) 812.

In one embodiment, the socket 802*b* of the post 802 is shaped like a circular portion containing two outward extending forks 816 (FIGS. 9A and 9B) at its base. As shown in FIG. 9A, the connecting pivot 806 contains a cylindrical expansion 818, shaped complimentarily to engage the outward extending forks 816 of the socket 802*b*. As also shown in FIG. 9A 9B, when the engagement portion of the socket 802*b* is coupled with the mating portion 820 of the connecting pivot 806, post 802 can be locked against its mounting pad 810 into a rotatable position along the axis of the connecting pivot 806.

Returning briefly to FIGS. 8A-8C, and with particular reference to FIG. 8A, it will be seen that the threaded end of each post 802 allows for a telescoping action when the post 802 inserted into a mating threaded coupler present in the body or housing of the device to which it is attached (e.g., an attachment assembly 800).

As shown in FIG. 8B, when the post 802 is coupled to a mounting pad 110, and attached to an instrument 10, the threaded post 802 provides the device 800 with a degree of vertical height adjustment relative to its position on the instrument 10.

It will be readily ascertained that the mounting pad 810 can be secured to the instrument 10 using a variety of methods, such as adhesive tape, suction cup or mechanical fastening. Since the directional placement of the mounting pad 810 determines the axis of rotation for the post 802 along it's mating connecting pivot 806, each mounting pad 810 can be attached to the instrument 10 in a variety of directions to allow for the appropriate post 802 rotation to suit the contours and shape of the instrument 10.

As shown in FIG. 8C, a stringed instrument attachment 800 having three posts 802 would provide an instrument player with a great deal of positioning ability. Additionally, since each post 802 can be rotatably locked into position along the axis of its mating connecting pivot 806 when attached to a mounting pad 810, the device 800 can be situated and angled to suit the contours of the instrument 10.

The quick coupling system depicted in FIGS. 8A to 9B and described herein provides several advantages. It allows the player of a stringed instrument as instrument 10 to quickly attach a string vibration device to an instrument without having to adjust and re-calibrate the position of the device every time the device is removed and reattached to the instrument. When the device is removed from the instrument, only the small and unobtrusive mounting pads remain affixed to the instrument, allowing the player to use the instrument without any hindrances from the quick coupling system.

Using embodiments consistent with the present disclosure, a string vibration device can be removed quickly from the instrument by releasing the posts from the mounting pads. In one embodiment, the connecting pivots are threaded. By unfastening the connecting pivots, the posts can be released from the mounting pads, allowing the device to be quickly detached from the instrument. In other embodiment, the connecting pivot and mounting pad may be coupled by a ball and groove design.

In one embodiment, the posts contain threaded ends, which when threaded into the body of the device, lock the posts at a preset depth, so there is no need to readjust the depth of each post to suit the angles and contours of the instrument when the device is removed and reattached. In other embodiment, the post and body may be coupled by a ball and groove design. Additionally, since the mounting pads remain affixed to the instrument, the circular portion of the socket on each post will engage its mating connecting pivot at the appropriate angle, eliminating the need to reposition each mounting pad to suit the angles and contours of the instrument when the device is removed and reattached.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

The methods described herein may be implemented in software, hardware, or a combination thereof, in different embodiments. In addition, the order of methods may be changed, and various elements may be added, reordered, combined, omitted, modified, etc. All examples described herein are presented in a non-limiting manner. Various modifications and changes may be made as would be obvious to a person skilled in the art having benefit of this disclosure. Realizations in accordance with embodiments have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

While the foregoing is directed to embodiments of the present invention, other and further embodiments of the invention may be devised without departing from the basic scope thereof, and the scope thereof is determined by the claims that follow.

The invention claimed is:

1. An attachment for use with a stringed musical instrument, comprising a rotatable shaft;

at least one group of one or more string engaging elements coupled to the rotatable shaft, each string engaging element of a group being positionable in a first orientation for driven rotary engagement with a corresponding string of the musical instrument and in a second orientation; and at least one key actuator operatively associated with each group of one or more string engaging elements, the at least one key actuator being manipulable so as to urge each string engaging element of a group into at least one of the first orientation or the second orientation, wherein the at least one key actuator is manipulable into an actuated position for urging a first string engaging element into the first orientation for rotation at a first speed, when an adjacent string of the musical instrument is not bent, and for urging the first string engaging element into the second orientation for rotation at a second speed when the adjacent string of the musical instrument is bent in a direction toward the first string engaging element, and whereby a speed at which the first string engaging element rotates is determined by both a speed at which the rotatable shaft rotates and a degree to which the adjacent string is urged into contact with the first string engaging element.

2. The attachment of claim 1, further comprising a motor coupled to the rotatable shaft and operable to cause rotation thereof, and a variable speed controller to enable modification to a speed of rotation for the rotatable shaft and string engaging elements.

3. The attachment of claim 2, wherein the second speed is faster than the first speed.

4. An attachment for use with a stringed musical instrument, comprising a rotatable shaft;

at least one group of one or more string engaging elements coupled to the rotatable shaft, each string engaging element of a group being positionable in a first orientation for driven rotary engagement with a corresponding string of the musical instrument and in a second orientation; and at least one key actuator operatively associated with each group of one or more string engaging elements, the at least one key actuator being manipulable so as to urge each string engaging element of a group into at least one of the first orientation or the second orientation, wherein each string engaging element of a group is a wheel defining a central bore circumscribed by a bearing surface, the central bore being dimensioned and arranged to receive the rotatable shaft, and wherein the central bore defined by each respective wheel has a diameter sufficiently larger than a diameter of the rotatable shaft as to permit canting movement of the respective wheel into the first orientation when a corresponding key actuator is manipulated and to permit floating movement when a corresponding key actuator is not manipulated.

5. An attachment for use with a stringed musical instrument, comprising a rotatable shaft;

at least one group of one or more string engaging elements coupled to the rotatable shaft, each string engaging element of a group being positionable in a first orientation for driven rotary engagement with a corresponding string of the musical instrument and in a second orientation; and at least one key actuator operatively associated with each group of one or more string engaging elements, the at least one key actuator being manipulable so as to urge each string engaging element of a group into at least one of the first orientation or the second orientation, wherein a first group of string engaging elements comprises a first string engaging element, a second string engaging element, and a gang selector dimensioned and arranged to lock a first key actuator and a second key actuator together to thereby cause the first and second string engaging elements to move in tandem when at least one of the first key actuator or second key actuator is depressed.

6. The attachment of claim 4, wherein each string engaging element of a group is free to float, relative to the rotatable shaft and a corresponding string, while in the second orientation.

7. The attachment of claim 4, wherein a first group of string engaging elements comprises a first wheel, a second wheel, and a gang selector dimensioned and arranged to lock a first key actuator and a second key actuator together to thereby cause the first and second wheel to move in tandem when at least one of the first key actuator or second key actuator is depressed.

8. The attachment of claim 4, wherein each respective wheel defines a plurality of teeth having surfaces dimensioned and arranged to engage a corresponding string while an associated key actuator is manipulated.

9. The attachment of claim 4, further comprising a motor coupled to the rotatable shaft and operable to cause rotation thereof.

10. The attachment of claim 9, further including a speed control system to enable modification to a speed of rotation for the rotatable shaft and string engaging elements.

11. The attachment of claim 10, wherein the speed control system is a variable speed controller.

12. The attachment of claim 9, further including a power management system comprising at least one sensor for determining when tonal quality variability is at least one of appropriate or required, the power management system being responsive to the at least one sensor to initiate rotation of the rotatable shaft while availability of tonal quality modification is needed and to terminate rotation when availability of tonal quality modification is no longer required.

13. An attachment for use with a stringed musical instrument, comprising a rotatable shaft;

at least one group of one or more string engaging elements coupled to the rotatable shaft, each string engaging element of a group being positionable for driven rotary engagement with a corresponding string of the musical instrument;

at least one key actuator operatively associated with each group of one or more string engaging elements, the at least one key actuator being manipulable so as to urge each string engaging element of a group into engagement with a corresponding string of the musical instrument;

a housing defining a plurality of attachment points, the rotatable shaft, at least one group of one or more string engaging elements, and at least one key actuator being coupled to the housing and operatively associated therewith; and a coupling system for attachment of the housing to the musical instrument, the coupling system including:

a plurality of mounting blocks, each mounting block defining a planar mounting surface and at least one transverse bore;

a plurality of pivotable rods, each pivotable rod having a proximal portion defining a transverse recess alignable with the at least one transverse bore of a corresponding mounting block and a distal threaded portion dimensioned and arranged for threaded engagement with one of the attachment points; and a plurality of mounting screws, each insertable through a respective transverse recess into a transverse bore of a corresponding mounting block.

14. The attachment of claim 13, wherein each mounting block defines a plurality of transverse bores bisected by a plane parallel to the planar mounting surface.

15. The attachment of claim 14, wherein each transverse recess is dimensioned to allow pivoting movement, of a pivotable rod about an axis of rotation defined by an axis extending through a center of a respective transverse bore, while a mounting screw is threaded into the respective transverse bore.

16. A musical instrument, comprising:

a neck;

a body;

a plurality of strings coupled to the neck and body so as to permit vibration relative thereto; and an attachment, the attachment including a rotatable shaft;

at least one group of one or more string engaging elements coupled to the rotatable shaft, each string engaging element of a group being positionable in a first orientation for driven rotary engagement with a corresponding string of the musical instrument and in a second orientation; and at least one key actuator operatively associated with each group of one or more string engaging elements, the at least one key actuator being manipulable so as to urge each string engaging element of a group into at least one of the first orientation or the second orientation, wherein each string engaging element of a group is a wheel defining a central bore circumscribed by a bearing surface, the central bore being dimensioned and arranged to receive the rotatable shaft, and wherein the central bore defined by each respective wheel has a diameter sufficiently larger than a diameter of the rotatable shaft as to permit canting movement of the respective wheel into the first orientation when a corresponding key actuator is manipulated and to permit floating movement when a corresponding key actuator is not manipulated.

17. The musical instrument of claim 16, wherein a first group of string engaging elements comprises a first wheel, a second wheel, and a gang selector dimensioned and arranged to lock a first key actuator and a second key actuator together to thereby cause the first and second wheel to move in tandem when at least one of the first key actuator or second key actuator is depressed.

18. The musical instrument of claim 16, wherein the at least one key actuator is manipulable into an actuated position for urging each string engaging element of a group into the first orientation for rotation at a first speed when the corresponding string of the musical instrument is not bent and for urging each string engaging element of a group into the second orientation for rotation at a second speed when the corresponding string of the musical element is bent in a direction toward the string engaging element.

19. An attachment for use with a stringed musical instrument, comprising a rotatable shaft;

at least one group of one or more string engaging elements coupled to the rotatable shaft, each string engaging element of a group being positionable in driven rotary engagement with a corresponding string of the musical instrument;

at least one key actuator operatively associated with each group of one or more string engaging elements, the at least one key actuator being manipulable so as to urge each string engaging element of a group into driven rotary engagement with a corresponding string of the musical instrument;

a motor coupled to the rotatable shaft and operable to cause rotation thereof; and a speed control system operative to modify a speed of rotation for the rotatable shaft and string engaging elements.

* * * * *